US009361871B1

(12) United States Patent
Truxes

(10) Patent No.: US 9,361,871 B1
(45) Date of Patent: Jun. 7, 2016

(54) WHISTLE WITH NON-SPHERICAL PEA

(71) Applicant: Robert G. Truxes, Chandler, AZ (US)

(72) Inventor: Robert G. Truxes, Chandler, AZ (US)

( * ) Notice: Subject to any disclaimer, the term of this patent is extended or adjusted under 35 U.S.C. 154(b) by 177 days.

(21) Appl. No.: 14/250,278

(22) Filed: Apr. 10, 2014

Related U.S. Application Data

(60) Provisional application No. 61/810,342, filed on Apr. 10, 2013, provisional application No. 61/810,584, filed on Apr. 10, 2013.

(51) Int. Cl.
*G10K 5/00* (2006.01)

(52) U.S. Cl.
CPC ..... *G10K 5/00* (2013.01)

(58) Field of Classification Search
CPC ..... G10K 5/02
USPC ..... 116/137 R; 446/204, 205, 206, 216
See application file for complete search history.

(56) References Cited

U.S. PATENT DOCUMENTS

| | | | |
|---|---|---|---|
| 696,814 | A | 4/1902 | Hatch |
| 777,538 | A | 12/1904 | Puckett |
| 831,392 | A | 9/1906 | Warfel |
| 894,415 | A | 7/1908 | Wickland |
| 931,578 | A | 8/1909 | Divine |
| 2,083,669 | A | 6/1937 | Rhulmann |
| 2,454,105 | A | 11/1948 | Thompson |
| 2,507,934 | A | 5/1950 | Reichart |
| 2,798,452 | A | 7/1957 | Baer |
| 2,927,399 | A | 3/1960 | Bacon |
| 2,959,889 | A | 11/1960 | Gausewitz |
| 2,996,839 | A | 8/1961 | Bacon |
| 3,129,528 | A | 4/1964 | Gausewitz |
| 3,924,560 | A | 12/1975 | Kaftan |

(Continued)

FOREIGN PATENT DOCUMENTS

| | | |
|---|---|---|
| EP | 1249015 | 10/2002 |
| EP | 2400486 | 12/2011 |

(Continued)

OTHER PUBLICATIONS

Avner Strauss, The Pea in the Whistle, Whistle Museum: a web site dedicated to whistles, research and collecting whistles; www.whistlemuseum.com; viewed and printed on Apr. 10, 2014.

*Primary Examiner* — Lisa Caputo
*Assistant Examiner* — Irving A Campbell
(74) *Attorney, Agent, or Firm* — Letham Law Firm LLC; Lawrence Letham

(57) ABSTRACT

A whistle that includes a pea formed of two semi-spheres coupled together to form a non-spherical shape. The non-spherical shape results in unpredictable movement of the pea in a chamber of the whistle so as to produce a trill. An interior surface of the chamber may include flat portions that further cause unpredictable movement of the pea to produce the trill.

18 Claims, 13 Drawing Sheets

(56) References Cited

U.S. PATENT DOCUMENTS

| | | | | |
|---|---|---|---|---|
| 4,429,656 | A | 2/1984 | Weisenberger | |
| 4,849,646 | A | 7/1989 | Dahl | |
| 5,086,726 | A | 2/1992 | Sharp | |
| 5,546,887 | A | 8/1996 | Cameron | |
| 5,564,360 | A | 10/1996 | Wright | |
| 5,816,186 | A | 10/1998 | Shepherd | |
| 6,068,534 | A | 5/2000 | Strongin | |
| 6,109,202 | A * | 8/2000 | Topman | G10K 5/00 116/137 R |
| 6,413,139 | B1 | 7/2002 | Douglas | |
| 6,837,177 | B2 | 1/2005 | Tanaka | |
| 7,037,167 | B2 | 5/2006 | Primos | |
| 7,428,878 | B2 | 9/2008 | Kim | |
| 7,581,509 | B2 | 9/2009 | Eventoff | |
| 7,992,513 | B2 | 8/2011 | Shishido | |
| 8,006,634 | B2 | 8/2011 | Shishido | |
| 8,277,275 | B2 | 10/2012 | Drury | |
| 2003/0116078 | A1 * | 6/2003 | Topman | G10K 5/00 116/137 R |
| 2006/0171092 | A1 | 8/2006 | Corcoran | |
| 2012/0291693 | A1 | 11/2012 | Cheng | |
| 2014/0033988 | A1 | 2/2014 | Watts | |

FOREIGN PATENT DOCUMENTS

| | | |
|---|---|---|
| EP | 2416312 | 2/2012 |
| GB | 315624 | 7/1929 |
| GB | 447673 | 5/1936 |
| GB | 771935 | 4/1957 |
| GB | 799799 | 8/1958 |
| GB | 801250 | 9/1958 |
| WO | 0159756 | 8/2001 |
| WO | 03107324 | 12/2003 |

* cited by examiner

WHISTLE WITH NON-SPHERICAL PEA

FIELD OF THE INVENTION

Embodiments of the present invention relate to whistles.

BRIEF DESCRIPTION OF THE DRAWING

Embodiments of the present invention will now be further described with reference to the drawing, wherein like designations denote like elements, and.

DETAILED DESCRIPTION OF THE PREFERRED EMBODIMENTS

Figure 1:
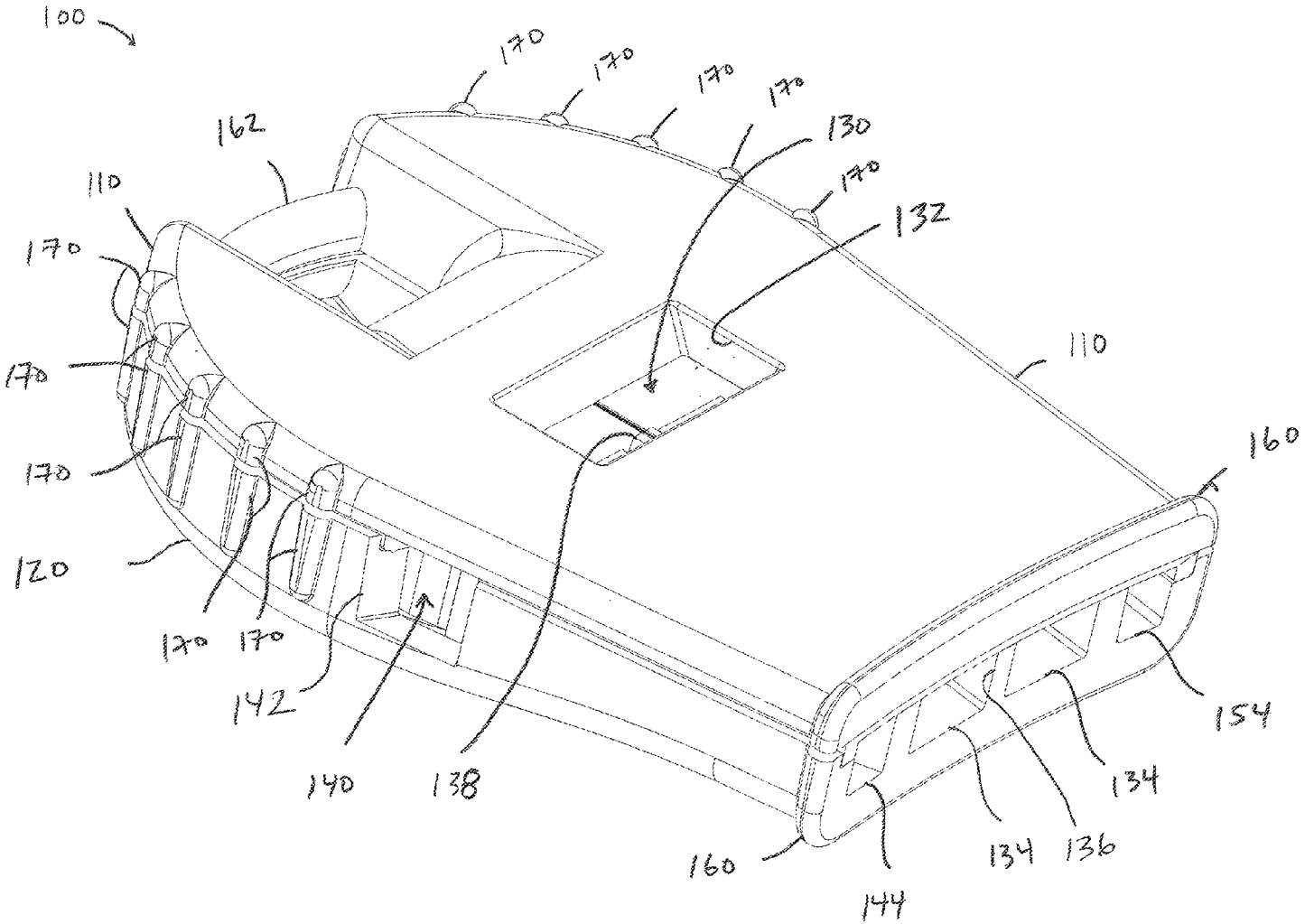
FIG. 1 is a perspective plan view showing the top and left side of a whistle according to various aspects of the present invention.
Figure 2:
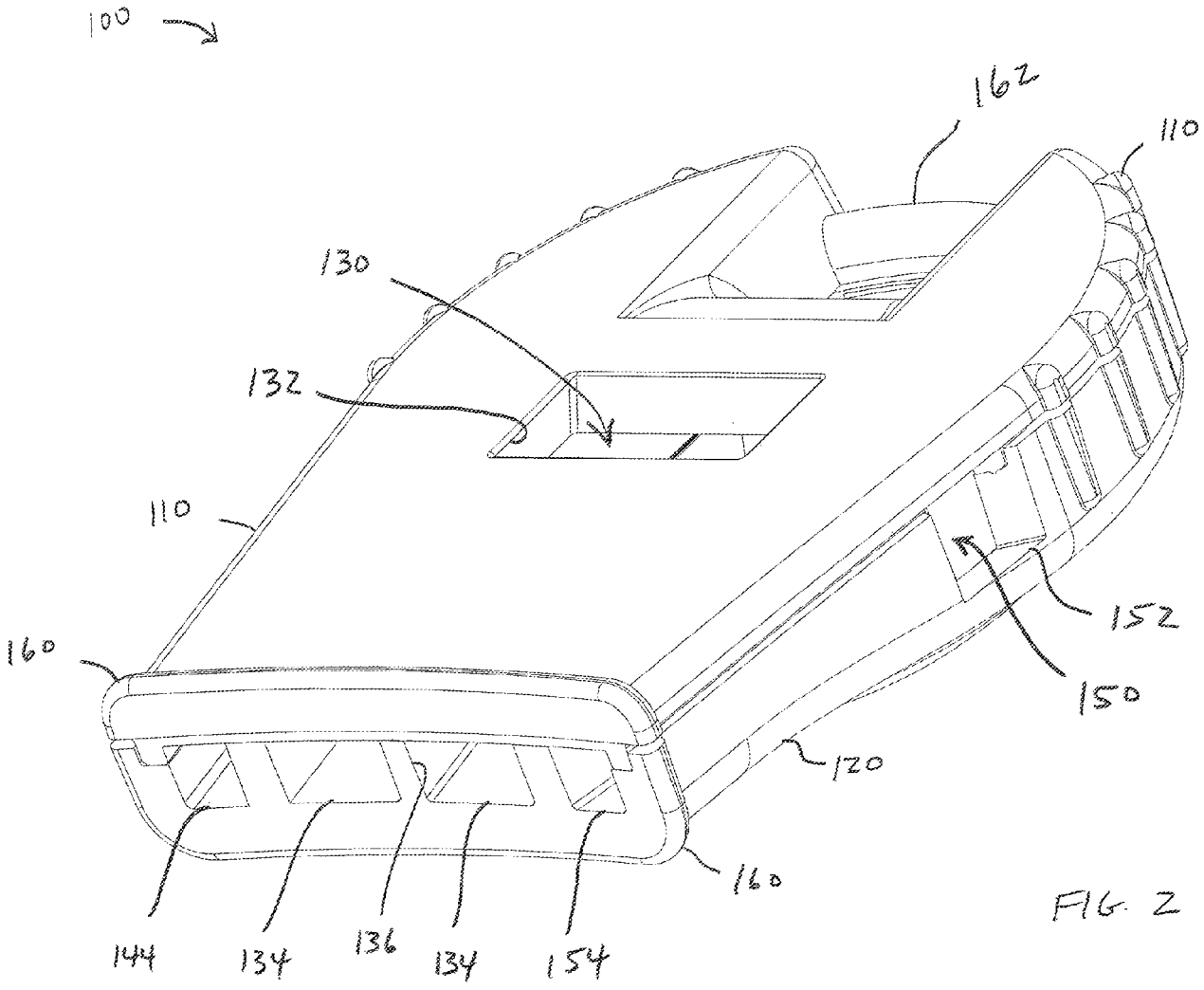
FIG. 2 is a perspective plan view showing the top and right side of the whistle.
Figure 3:
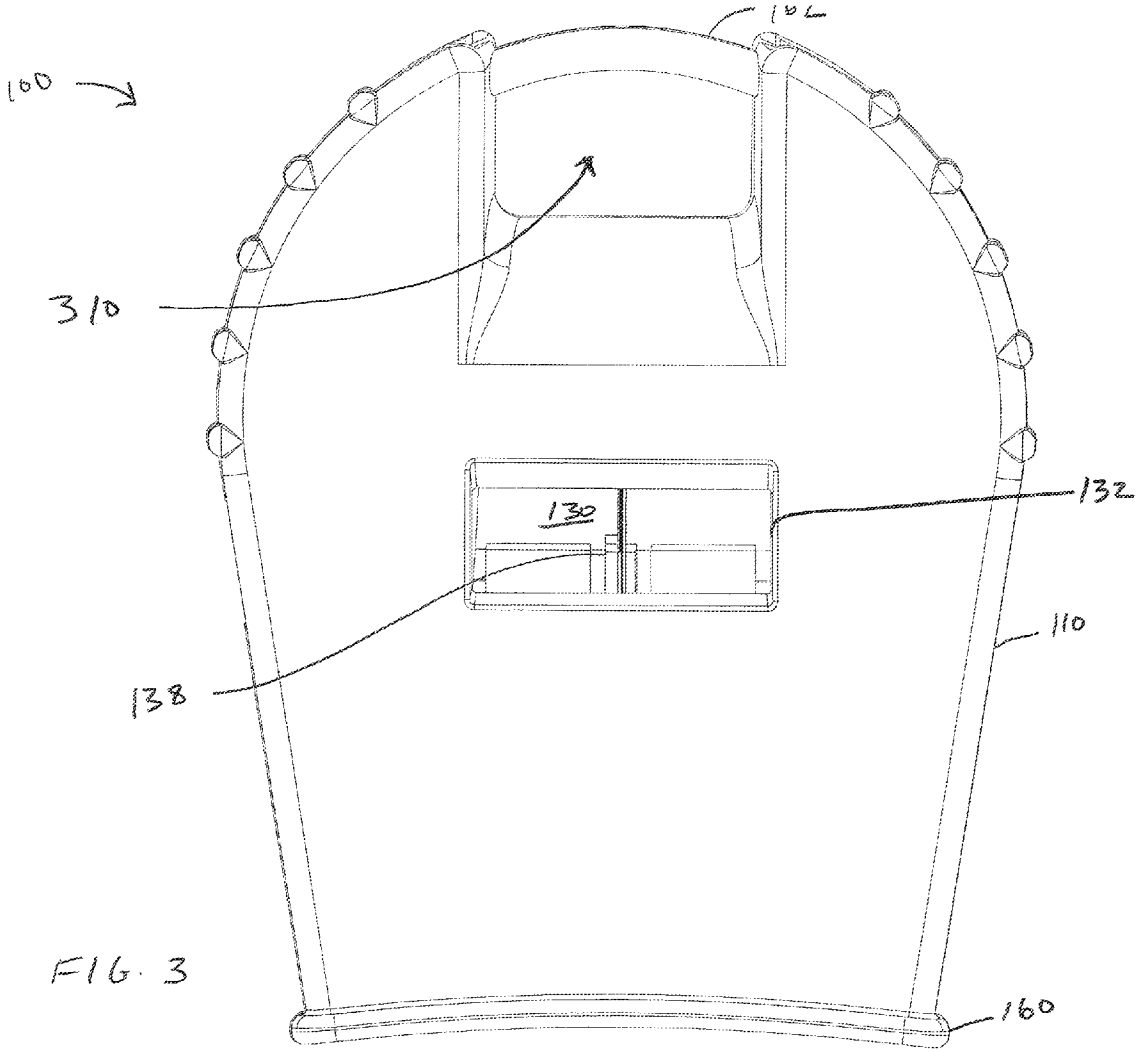
FIG. 3 is a plan view showing the top of the whistle.
Figure 4:
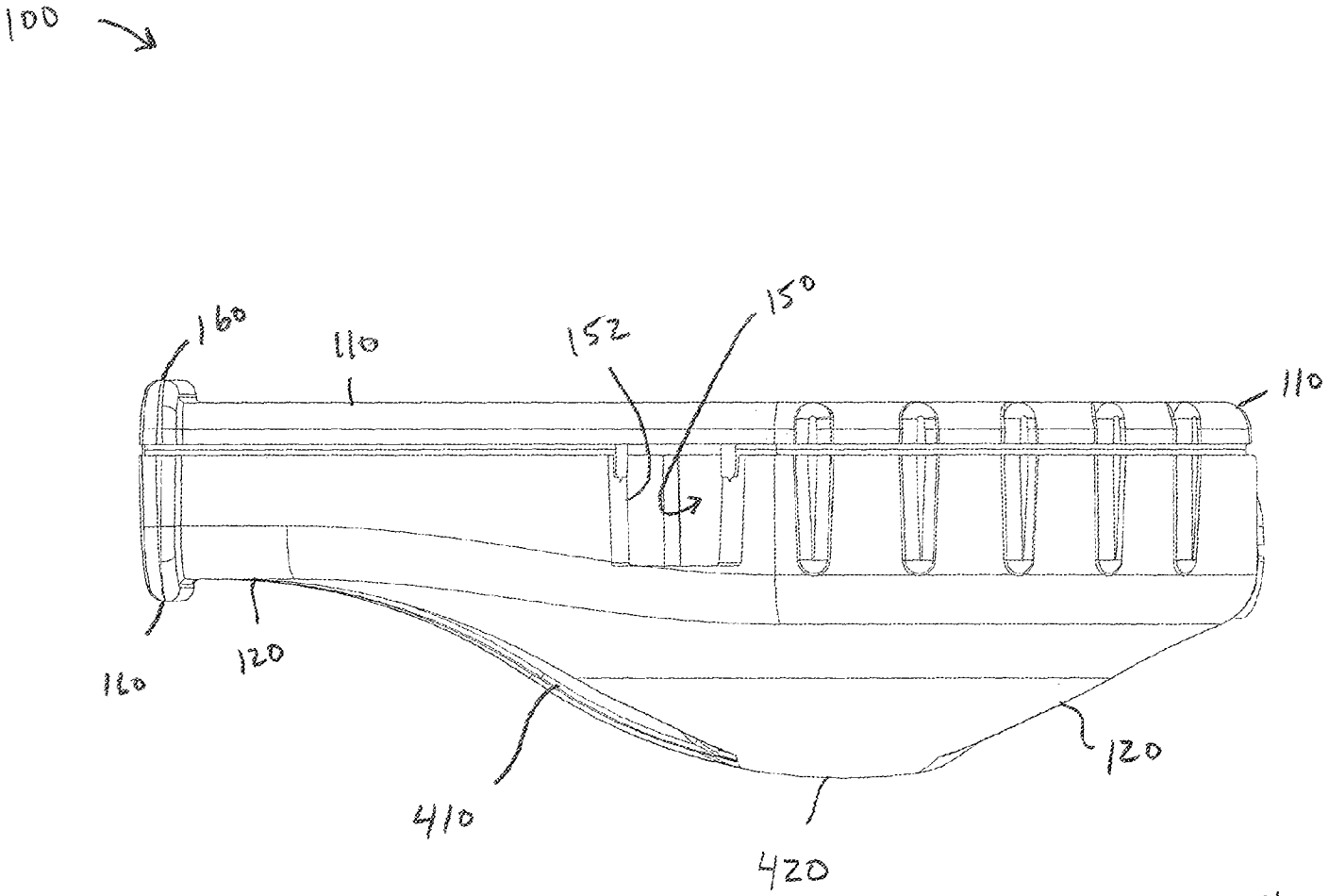
FIG. 4 is a plan view showing the right side of the whistle.
Figure 5:
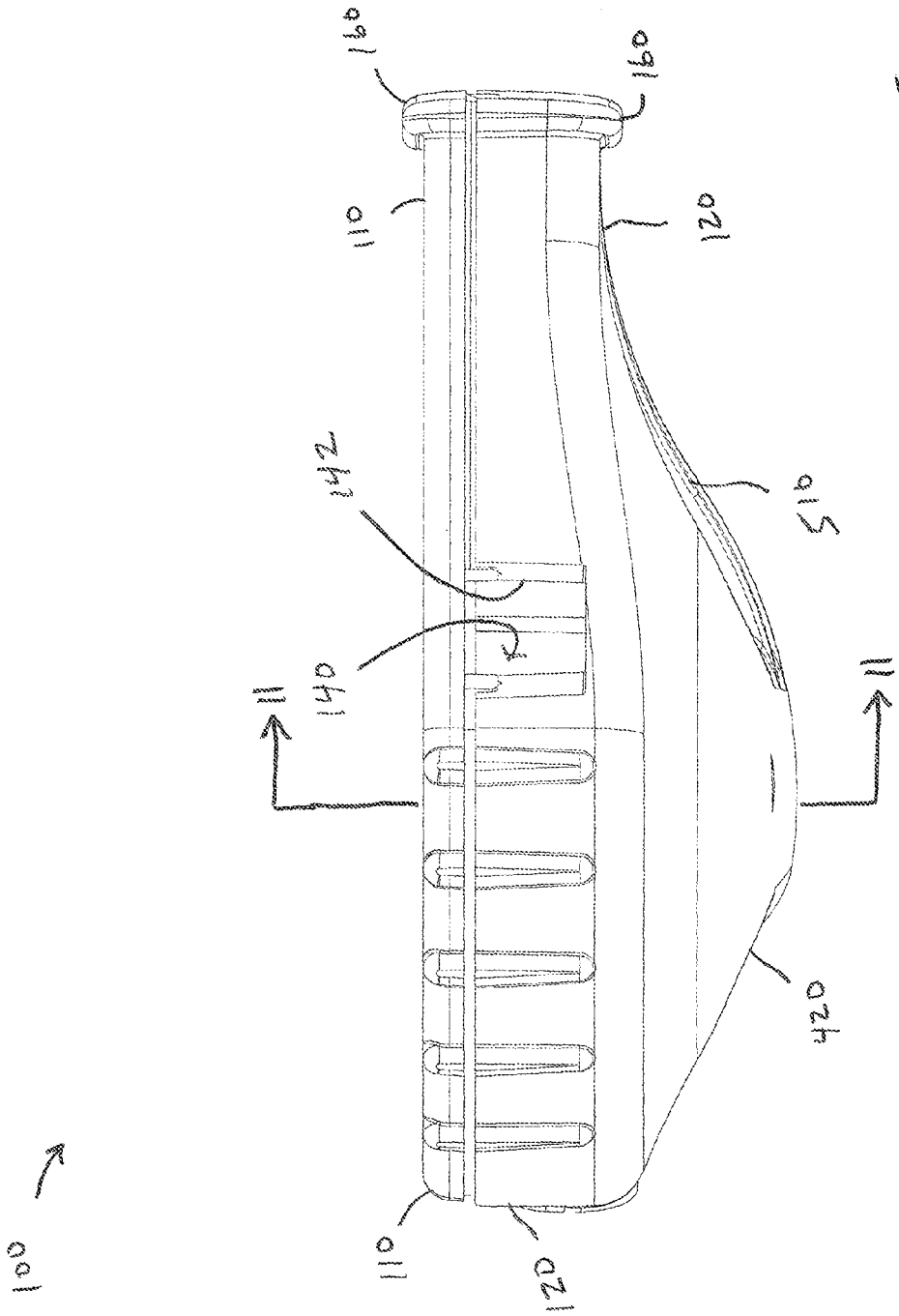
FIG. 5 is a plan view showing the left side of the whistle.
Figure 6:
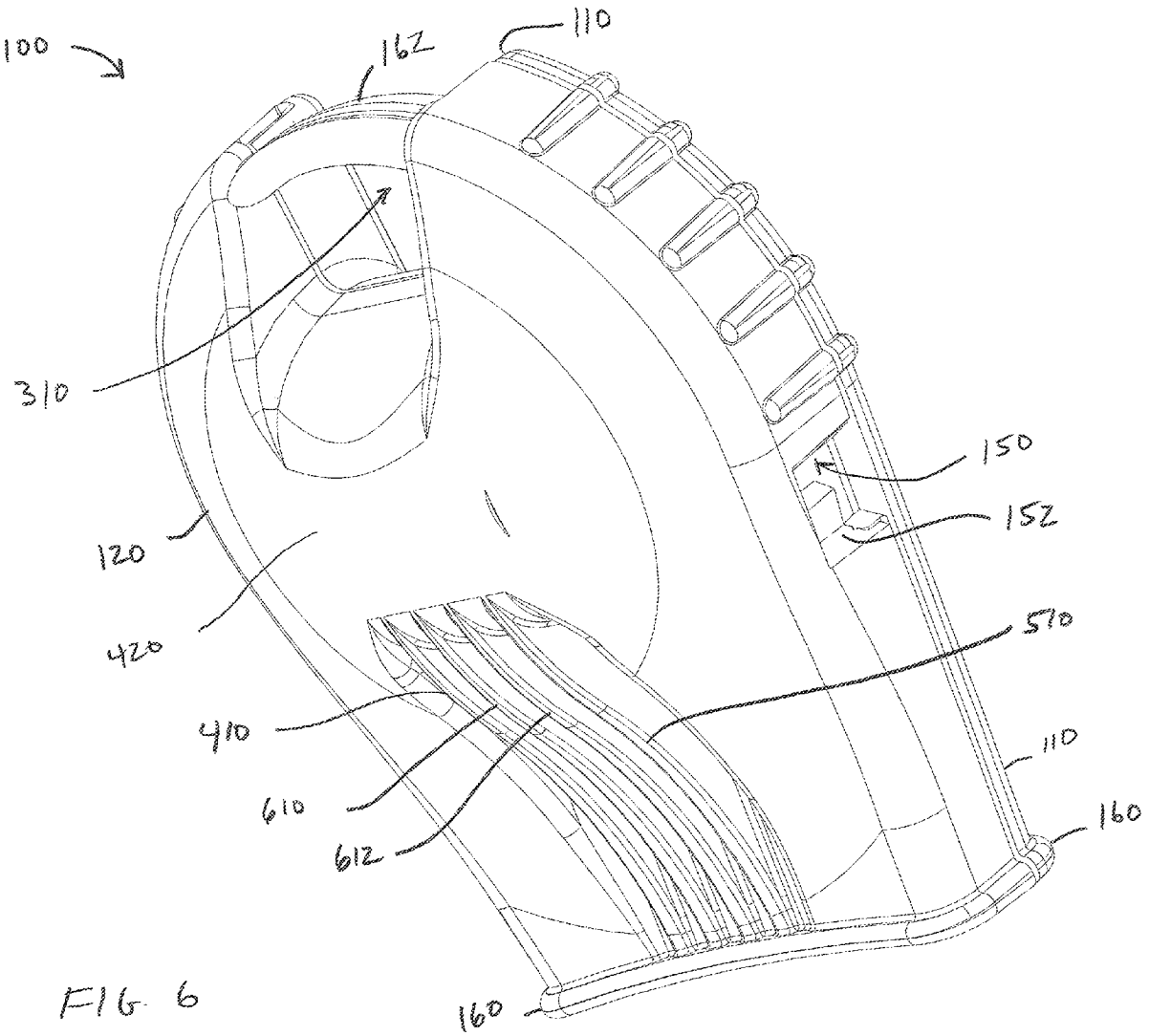
FIG. 6 is a perspective plan view showing the bottom and left side of the whistle.
Figure 7:
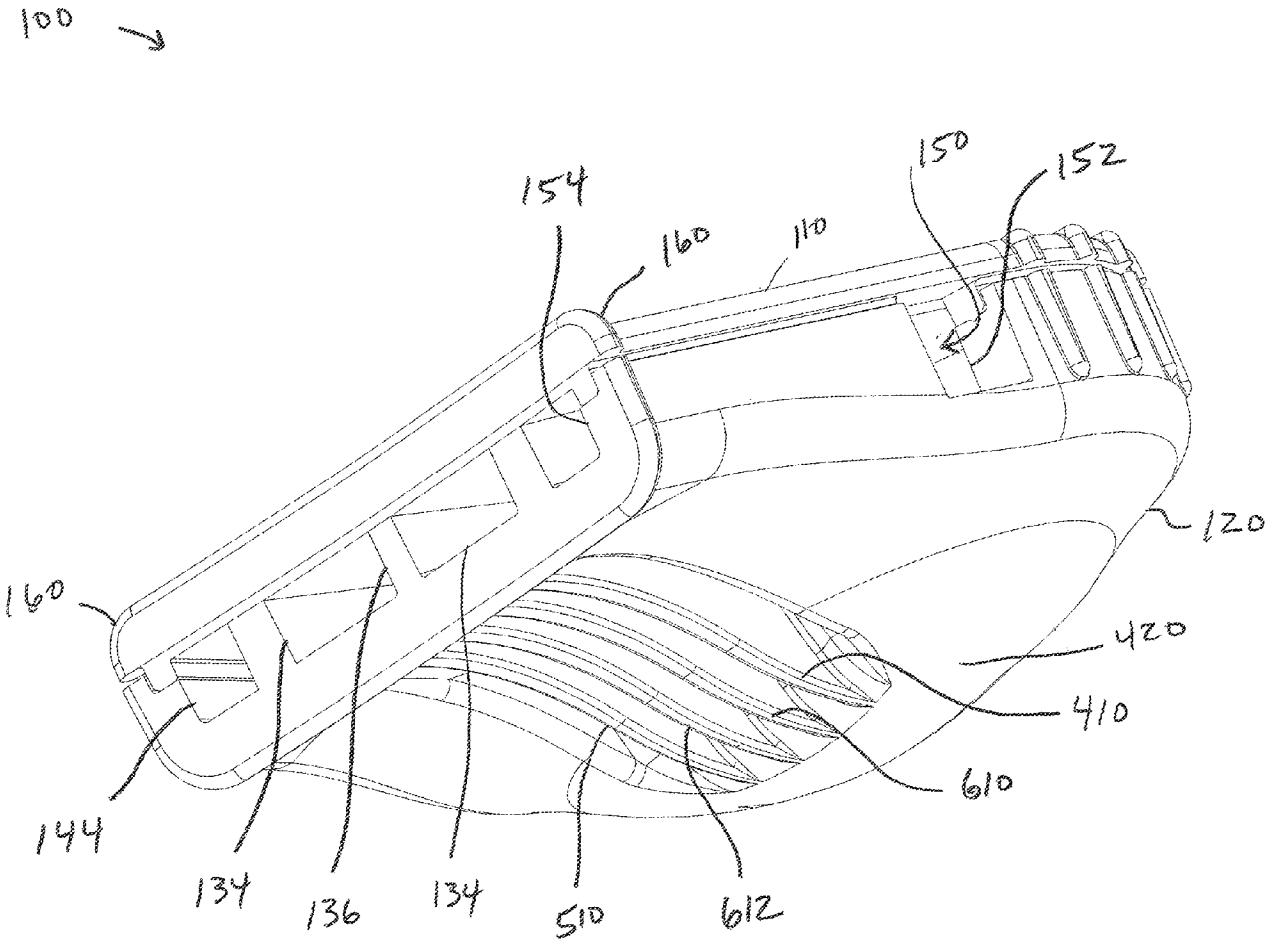
FIG. 7 is a perspective plan view showing the bottom and right side of the whistle.
Figure 8:
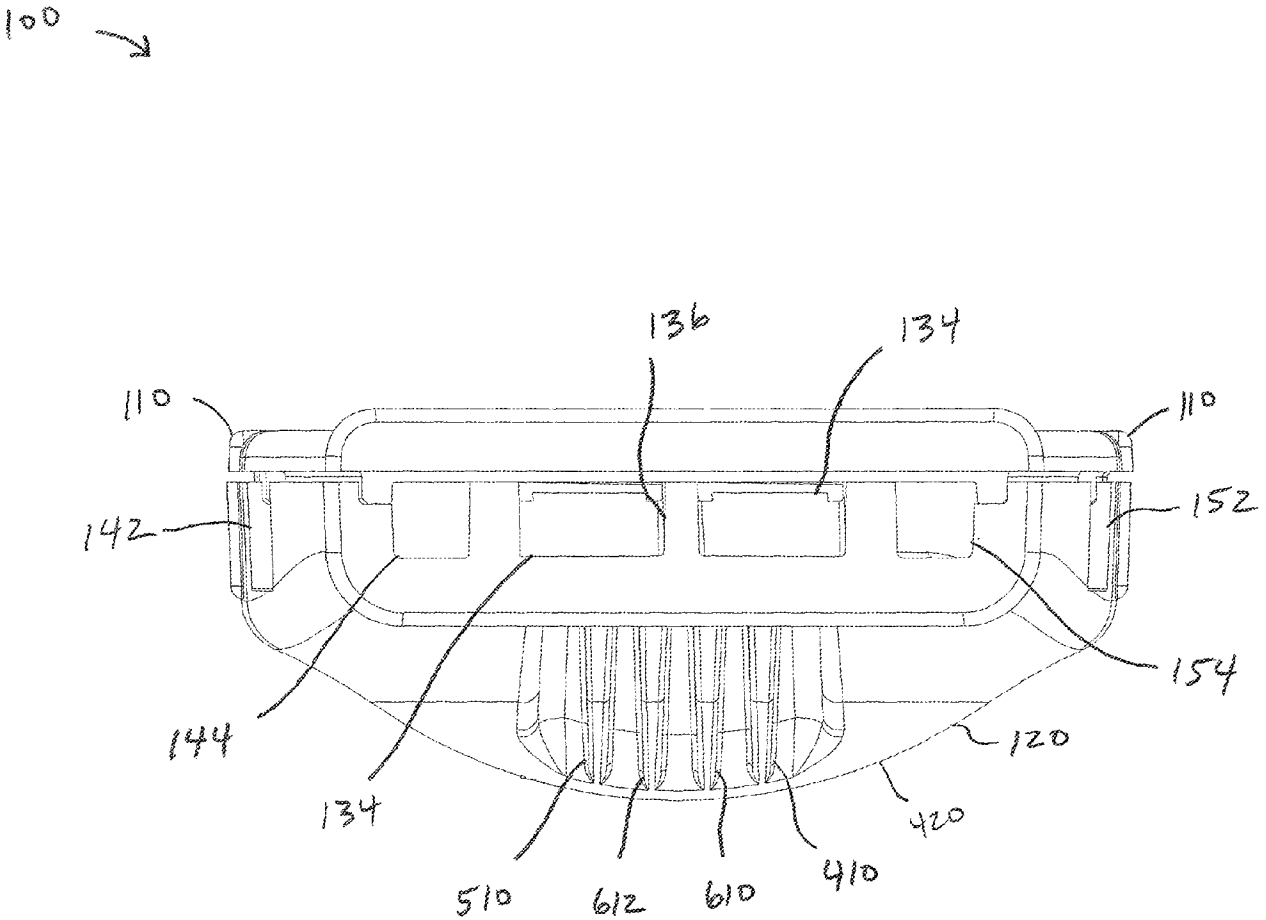
FIG. 8 is a plan view showing the front of the whistle.

A whistle produces a sound at a frequency when air is blown into the whistle chamber. A whistle having more than one chamber of different sizes may produce a sound for each chamber of a different frequency. Placing a pea (e.g., ball, sphere, object) in a chamber causes the frequency of the sound from the chamber to vary (e.g., trill) as the pea moves in the chamber.

A pea formed of two semi-spheres that are coupled together to form a non-spherical shape produces a unique trill because the shape of the pea causes unexpected movement of the pea in the chamber.

In an implementation of a whistle that includes a pea formed of off-set semi-spheres, whistle 100, as shown in FIGS. 1-11, includes lid 110 and body 120.

Lid 110 mechanically couples to body 120 to form pea chamber 130, low pressure chamber 140, high pressure chamber 150, pea flute 134, low pressure flute 144, high pressure flute 154, low pressure outlet 142, high pressure outlet 152, and grip 160. Lid 110 includes pea chamber outlet 132. Pea chamber 130 includes floor 920. Pea chamber 130 may further include ceiling 940. Low pressure flute 144 includes restrictor 1020. High pressure flute 154 includes restrictor 110.

Body 120 includes tongue 136 that separates (e.g., splits) pea flute 134 in to a first portion and a second portion. Air flows through both the first portion and the second portion of pea flute 134 to enter pea chamber 130. An end portion of tongue 136 enters pea chamber 130 to form turbulator 138. Turbulator 138 introduces turbulence into the air in pea chamber 130. Turbulence in the air that enters pea chamber 130 applies a force (e.g., pushes) on pea 1110 to move pea 1110 around in pea chamber 130.

Body 120 may include loop 162 and passage 310, rib 410, rib 510, rib 610, rib 612, and convex wall 420.

Pea 1110 includes semi-sphere 1210 and semi-sphere 1220. Semi-sphere 1210 include axis 1212. Semi sphere 1220 includes axis 1222.

A body provides structure for forming cavities, openings, passages, and a loop. A lid mechanically couples to the body. A lid provides structure for covering cavities to form chambers, forming outlets from chambers, and covering passages to form flutes. A lid may be mechanically coupled to a body using any conventional coupling process such as gluing, welding, friction fit, or snap fitting. A body and a lid may be formed of the same material or of different materials. A body and/or a lid may be formed of a single material or a combination of materials.

A body may include ribs for ascetic purposes, to reduce a weight (e.g., mass) of the body, and/or to increase the strength of the material that forms the body. A body and/or lid may include protrusions (e.g., bumps, ribs, grips) on an exterior of the body and/or lid, preferable on the sides thereof, to provide a surface for a human to manually grip the whistle. A body may include a loop that forms a passage through a portion of the body. The loop may couple to a lanyard and/or key ring via the passage.

A body may include a portion of a grip and a lid another portion of the grip so that the combination of the body and the lid forms a grip suitable for griping with a user's mouth and/or teeth to operate the whistle without manual support.

A flute comprises a passage that directs a flow of air into a chamber. A restrictor reduces the area of the flute at the entrance to the chamber to control the flow of air into the chamber. A restrictor may increase the pressure of the air that enters a chamber. A restrictor may increase the pressure of the air that enters a chamber proportionally to the amount the restrictor reduces the area of the flute at the entrance of the chamber.

A chamber receives a flow of air. A chamber includes an outlet for allowing the escape of air. The escape of air from the chamber produces a sound at a frequency. For a given air flow, a larger chamber produces a sound at a lower frequency than the frequency of the sound produced by a smaller chamber.

A body may include a convex wall for increasing a volume of one or more chambers in an assembled whistle. An external surface of the convex wall is convex and may appear to have a dome-like shape. A convex wall may be of constant thickness so that an internal surface of the chamber is concave as the external surface is convex. A convex wall may be of varying thickness so that portions of the internal surface of the chamber are concave while other portions of the internal surface of the chamber are not concave. A lower portion of an internal surface of the convex wall may be flat to provide a floor in the chamber. An upper portion of an internal surface of a chamber may be flat to provide a ceiling in the chamber. A flat floor and/or a ceiling in a chamber may interact with a pea to influence movement of the pea in the chamber differently than a concave surface.

A pea may be positioned in a chamber. The size of a pea is greater than the size of the outlet of the chamber, so that the pea cannot exit the chamber. Movement and/or turbulence of air through a chamber acts on a pea to move the pea within the chamber. A pea may move consistent with movement of air in a chamber until the pea contacts an interior surface of the chamber. Contact of the pea with an interior surface of the chamber results in a change in the direction of the movement of the pea according to know, but possible complex in this situation, laws of physics.

Physical characteristics of the pea, such as shape, surface area, and resilience influence how a collision with an interior wall of a chamber affects the direction and speed of movement of the pea. Physical characteristics, in particular shape and surface area, determine the movement of the pea responsive to air flow and/or turbulence. Air flow on a flat surface of a pea may affect movement of the pea differently than air flow on a rounded (e.g., spherical, convex) portion of the pea. Physical characteristics, in particular shape and resilience, determine the movement of the pea responsive to a collision by the pea with an interior (e.g., internal) surface of a chamber. A pea having uneven surfaces or flat surfaces, as opposed to round or spherical, may move (e.g., slide, transpose) along a wall for a distance before the pea bounces from a surface. A pea may bounce from a surface in response to a non-spherical portion and/or a spherical portion of the pea contacting a surface.

Resiliency of the material that forms the pea may determine the movement of the pea upon collision with an interior surface.

A shape of the interior of a chamber further determines how a pea moves in a chamber responsive to air flow, turbulence and/or collisions. A chamber with a substantially uniform interior surface may result in substantially uniform movement of the pea. A chamber with a non-uniform interior surface may result in more random movement of the pea. For example, a chamber that has a substantially concave shape may include a surface that is substantially flat. A flat portion (e.g., bottom, floor, top, ceiling) on an interior surface causes different movement of the pea responsive to a collision than a collision with substantially concave portions.

Movement of the pea responsive to the flow of air, turbulence, and/or collisions alters the sound made by the air as it exits the outlet of the chamber so that the frequency of the sound is altered between a first frequency and one or more other frequencies. The alteration of frequency is referred to as a trill. Movement of the pea responsive to the air flow, turbulence, and/or collisions determines the characteristics (e.g., speed of change, change in frequency) of the trill.

For example, body 120 mechanically couples with lid 110 to form whistle 100. Body 120 includes cavities, openings, and passages so that coupling body 120 with lid 110 forms pea chamber 130, pea outlet 132, pea flute 134, low pressure chamber 140, low pressure outlet 142, low pressure flute 144, high pressure chamber 150, high pressure outlet 152, and high pressure flute 154. Body 120 and lid 110 include protrusions that form grips 170 to aid manual grasping of whistle 100. Body 120 and lid 110 include protrusions that form grip 160 to aid gripping of whistle 100 by a mouth or teeth of a user while providing air flow from the user's lungs to the flutes. In one implementation, body 120 and lid 120 are formed of a plastic and body 120 couples lid 110 by welding.

Figure 9:
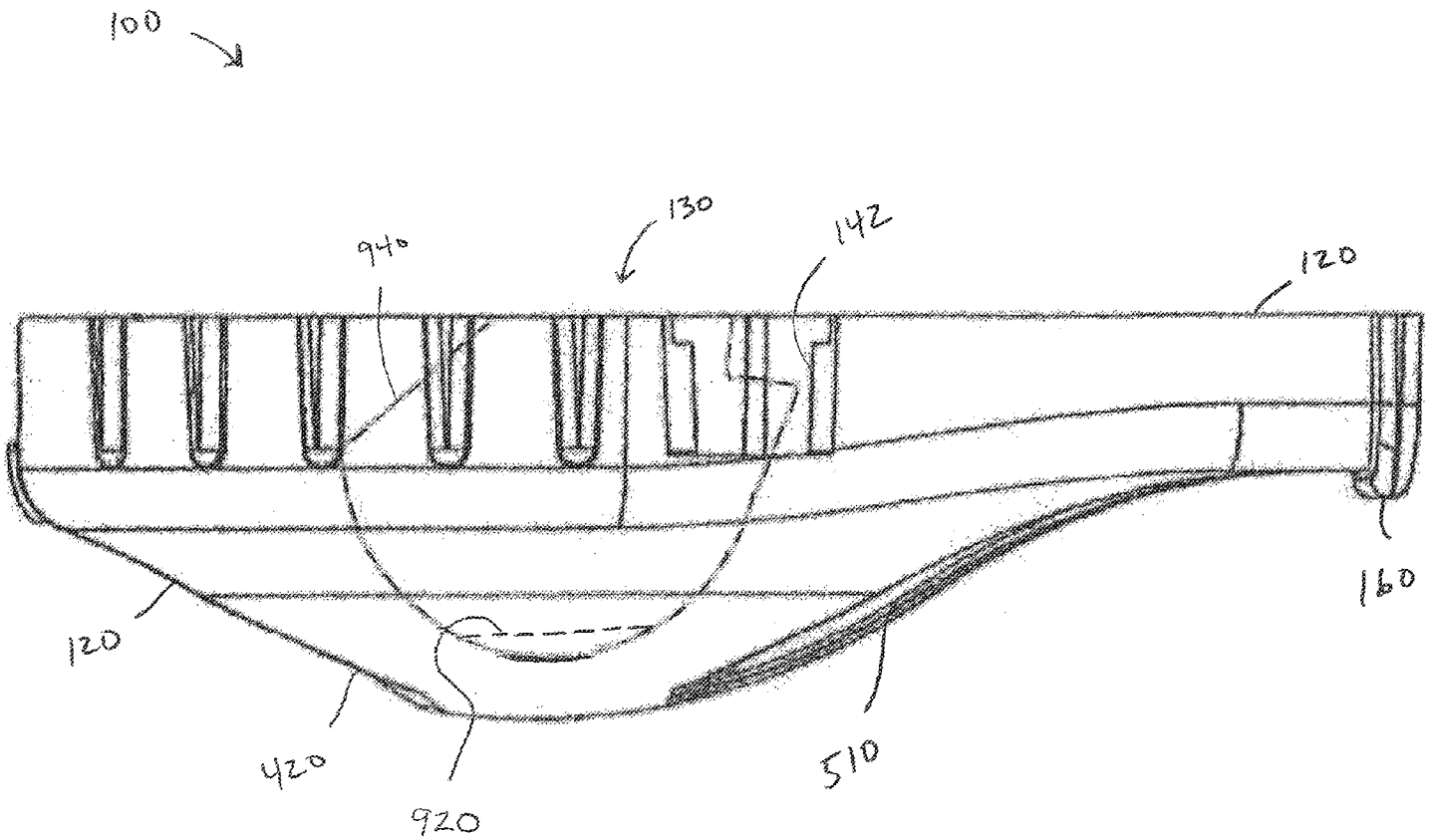
FIG. 9 is a plan view showing the left side of the whistle with a shape of the pea chamber indicated.
Figure 10:
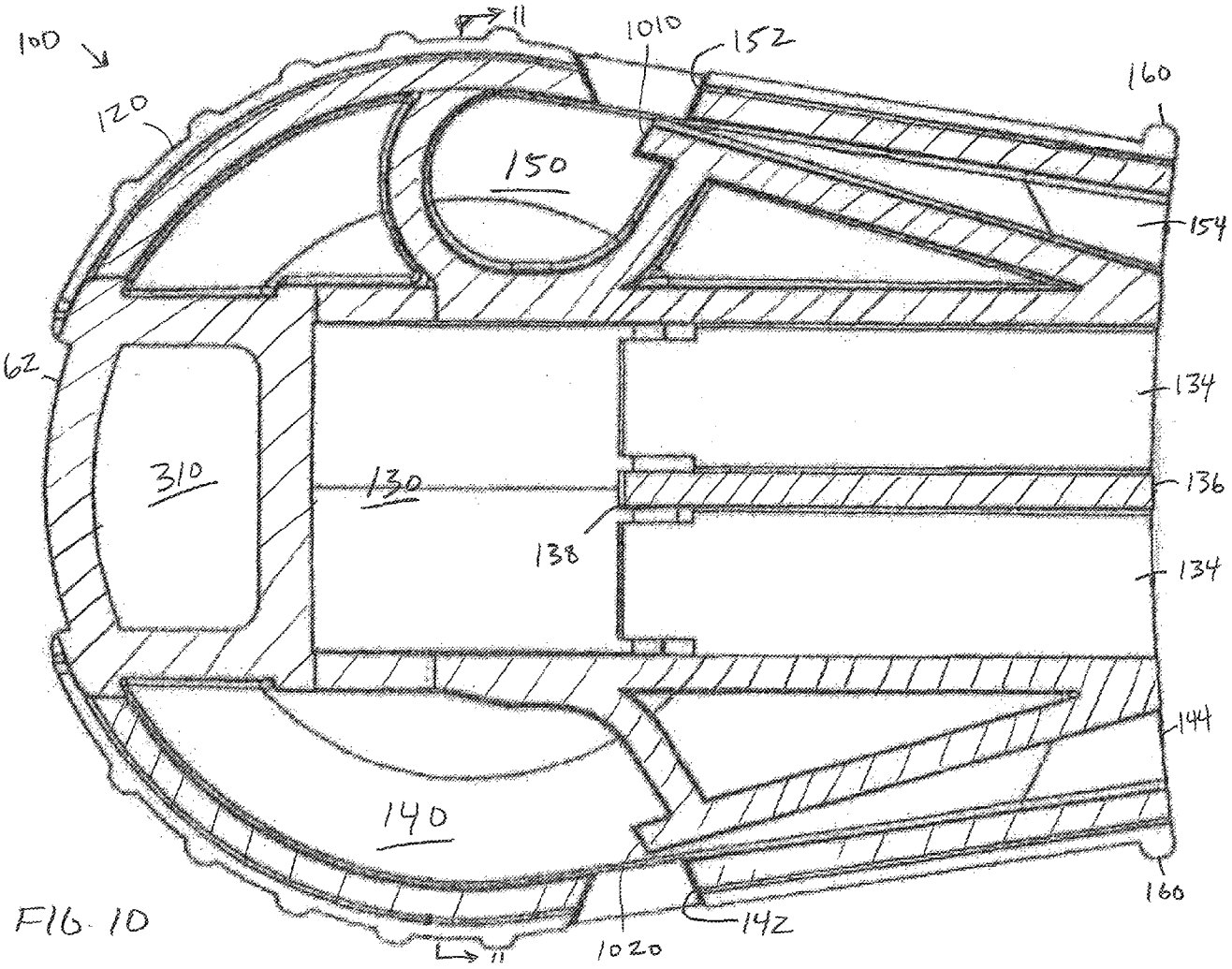
FIG. 10 is a plan view showing the top of the body of the whistle with the lid removed.
Figure 11:
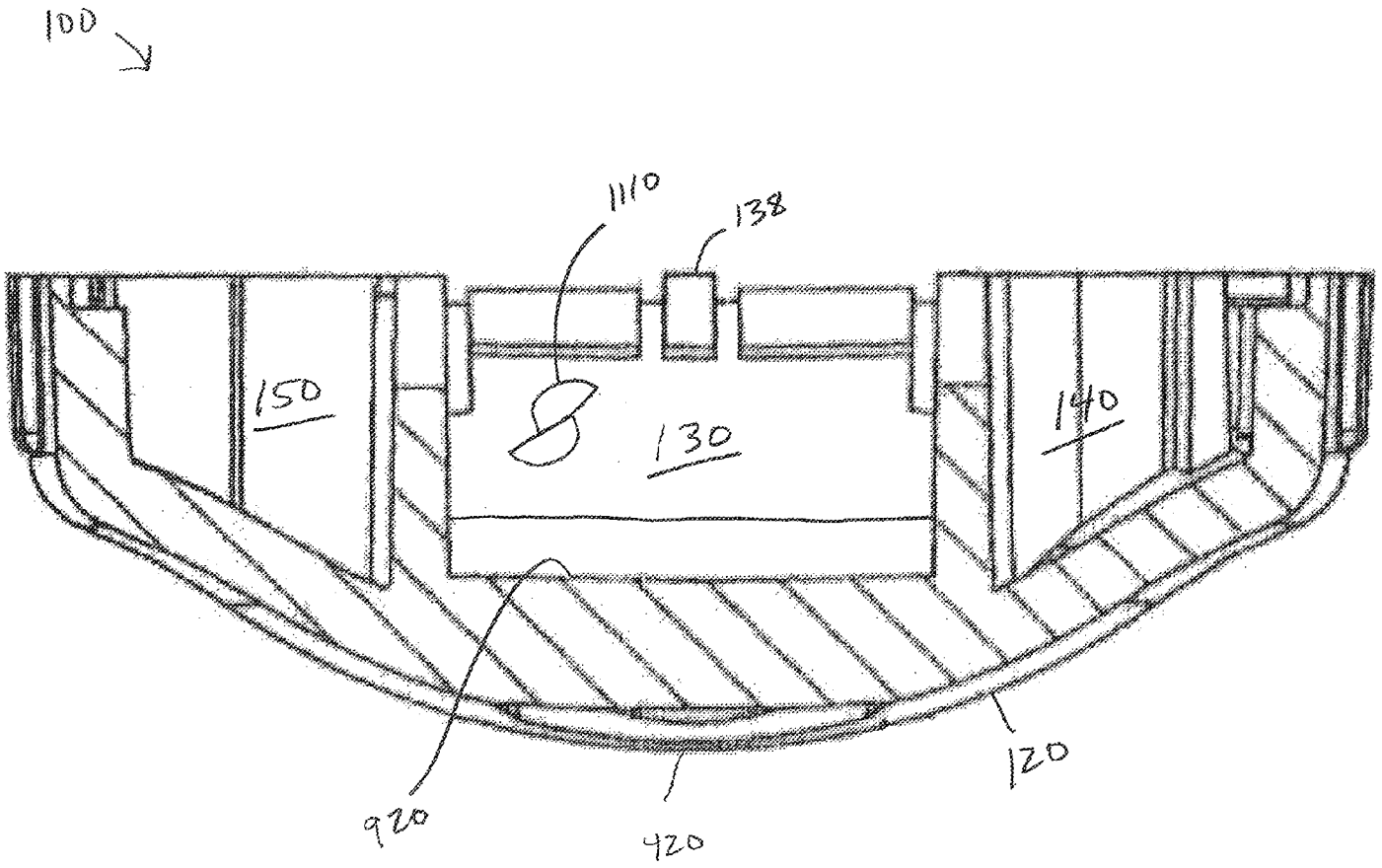
FIG. 11 is a plan view showing a cross-section of the body at 11-11 with the lid removed.
Figure 12:
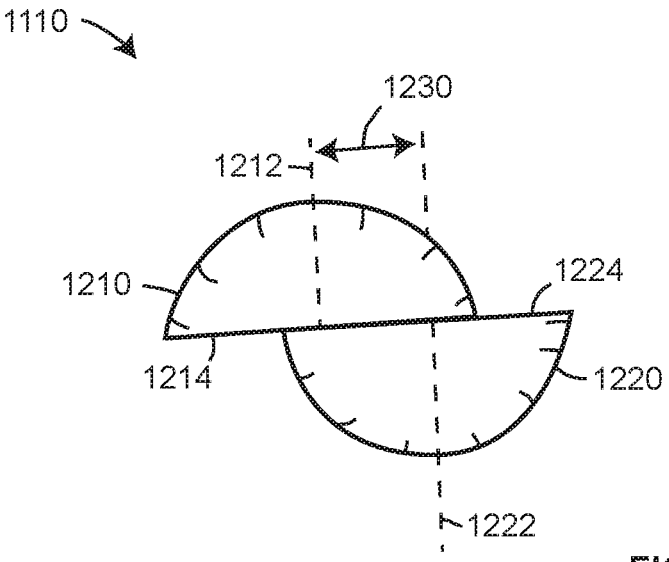
FIG. 12 is a plan view showing a side view of the pea according to various aspects of the present invention.
Figure 13:
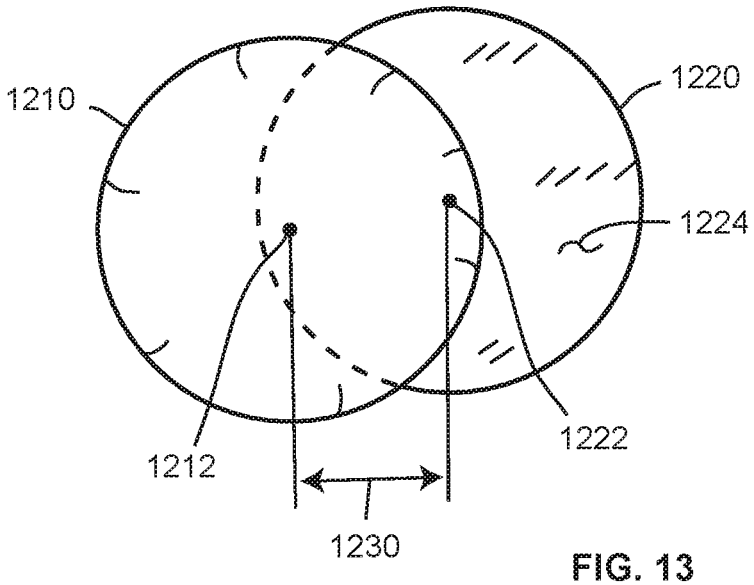
FIG. 13 is a plan view showing a top view of the pea.

Body 120 includes ribs 410, 510, 610, and 612 in a bottom portion of the exterior of body 120. Body 120 includes convex wall 420 in the bottom portion of body 120. Convex wall 420 provides increased volume on an interior of whistle 100 to increase the volume of the interior of at least pea chamber 130. Convex wall 420 may further provide increase volume to low pressure chamber 140 and/or high pressure chamber 150. A two-dimensional view of the shape of the internal volume of pea chamber 130 from the side of body 120 is shown in FIG. 9. The concave shape of the interior of pea chamber 130 is altered by flat surfaces floor 920 and ceiling 940. Floor 920 and/or ceiling 940 interact with pea 1110 to influence movement of pea 1110 within pea chamber 130.

Low pressure flute 144 directs air flow past restrictor 1020 into low pressure chamber 140. High pressure flute 154 directs air flow past restrictor 1010 into high pressure chamber 150. Restrictors 1010 and 1020 reduce an area of low pressure flute 144 and high pressure flute 154 respectively to increase the pressure of the air flowing into low pressure chamber 140 and high pressure chamber 150 respectively. Restrictor 1010 restricts the area of the passage of high pressure flute 154 more than restrictor 1020 restricts the passage of low pressure flute 144, so that the pressure of the air entering the high pressure chamber 150 is greater than the pressure of the air entering the low pressure chamber 140.

Pea flute 134 directs air into pea chamber 130. Pea flute is split (e.g., separated) into two portions by tongue 136. Splitting pea flute 134 into portions increases the turbulence of the air entering pea chamber 130. An end portion of tongue 136, turbulator 138, projects from pea flute 134 into pea chamber 130. Turbulator 138 increases the turbulence of the air in pea chamber 130.

Pea chamber 130 receives a flow of air from (e.g., via) pea flute 134. Air exits pea chamber 130 via pea chamber outlet 132. Low pressure chamber 140 receives a flow of air from low pressure flute 144. Air exits low pressure chamber 140 via low pressure outlet 142. High pressure chamber 150 receives a flow of air from high pressure flute 154. Air exits high pressure chamber 150 via high pressure outlet 152. An area of low pressure chamber 140 is greater than the area of pea chamber 130 which is greater than the area of high pressure chamber 150. For a given volume of air flow, the air that exits low pressure outlet 142 produces a sound at a frequency that it less than the frequency of the sound produced when air exits high pressure outlet 152 of high pressure chamber 150. The higher pressure of the air entering high pressure chamber 150 as opposed to the pressure of the air entering low pressure chamber 140 further contributes to the higher frequency of the sound that exits from high pressure outlet 152 as compared with the frequency of the sound that exits from low pressure outlet 142.

Pea 1110 is positioned in pea chamber 130. Air flow and/or turbulence in the air that enters pea chamber 130 apply a force (e.g., pushes) on pea 1110 to move pea 1110 around inside pea chamber 130. Pea 1110 may be positioned in pea chamber 130 prior to mechanically coupling lid 110 to body 120. Pea 1110, when formed of a resilient material (e.g., rubber), may be deformed and pushed into pea chamber 130 via pea chamber outlet after lid 110 is mechanically coupled to body 120.

Pea 1110 is formed by mechanically coupling semi-sphere 1210 and semi-sphere 1220. Semi-sphere 1210 and semi-sphere 1220 may be formed of a resilient material (e.g., rubber) that provides some bounce responsive to a collision. Semi-sphere 1210 and semi-sphere 1220 may be formed of the same material or different materials that have different physical properties such as resilience. Semi-sphere 1210 and semi-sphere 1220 may be the same or different sizes. Semi-spheres of the same size have about the same diameter across the flat portion (e.g., 1214, 1224) of the semi-sphere.

Semi-sphere 1210 and semi-sphere 1220 include axis 1212 and axis 1222 respectively. Axis 1212 and axis 1222 are orthogonal to and through the center of flat portion 1214 and flat portion 1224 of semi-sphere 1210 and semi-sphere 1220 respectively. Semi-sphere 1210 and semi-sphere 1220 are coupled to each other at flat portions 1214 and 1224. When semi-sphere 1210 is coupled to semi-sphere 1220 to form pea 1110, axis 1212 of semi-sphere 1210 does not align with axis 1222 of semi-sphere 1220. Axis 1212 is offset from axis 1222 by distance 1230.

Figure 14:
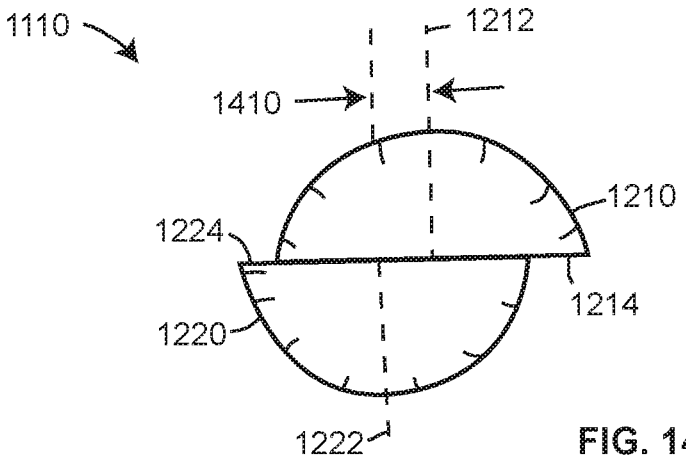
FIG. 14 is a plan view showing a side view of the pea according to various aspects of the present invention in which the offset is about 13%.

Distance 1230 may range from about 3% of the diameter of the flat portion (e.g., 1214, 1224) of the semi-sphere to about 50% of the diameter of the flat portion of the semi-sphere. Preferably, the offset is about 13% of the diameter of the flat portion of a semi-sphere. For example, in FIG. 14, offset 1410 is about 13 of the diameter of the flat portion of semi-sphere 1210.

For example, in an implementation the diameter of flat portion 1214 of semi-sphere 1210 and flat portion 1224 of semi-sphere 1220 is 0.3 inches plus or minus 0.015 inches. The offset between axis 1212 of semi-sphere 1210 and axis 1222 of semi-sphere 1220, which is distance 1230, ranges from 0.025 inches to 0.055 inches plus or minus 0.015 inches. Preferably, the offset distance 1230 is about 0.04 inches plus or minus 0.015 inches. The range of the offset distance 1230 expressed as a percentage of the diameter of flat portion 1214 or flat portion 1224 while taking into consideration the manufacturing tolerance of plus or minus 0.015 inches is about 3.3% to about 23.3%.

Figure 15:
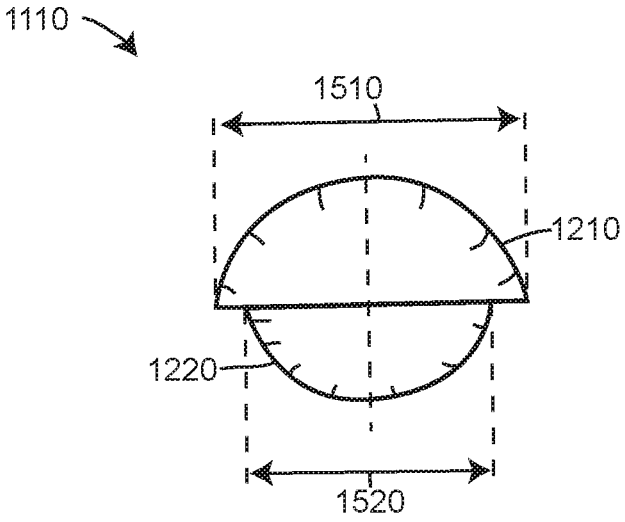
FIG. 15 is a plan view showing a side view of the pea according to various aspects of the present invention in which the diameter of one semi-sphere is greater than the diameter of the other semi-sphere.

In another implementation of pea 1110, the flat portion 1214 of semi-sphere 1210 has a greater diameter than flat portion 1224 of semi-sphere 1220. For example, in FIG. 15, diameter 1510 is greater than diameter 1520. When semi-sphere 1210 is coupled to semi-sphere 1220 to form pea 1110, axis 1212 of semi-sphere 1210 aligns with axis 1222 of semi-sphere 1220, but because of the difference in diameters of the semi-spheres, pea 1110 has a flat portion around it because the flat portion 1214 of the larger diameter semi-sphere 1210 is exposed and not covered by semi-sphere 1220. The amount of the flat portion of the larger semi-sphere that is exposed on each side of the larger semi-sphere may range from about 2% to about 20% of the diameter of the larger semi-sphere.

Air flow and/or turbulence through pea chamber 130 will operate differently on flat portions 1214 and 1224 than on the spherical portions of semi-sphere 1210 and semi-sphere 1220. When pea 1110 collides with an interior wall of pea chamber 130, flat portion 1214 and/or 1224 may contact the interior surface and alter the direction of the movement of pea 1110 responsive to the collision. Collisions of pea 1110 with flat interior portions (e.g., 920, 940) of pea chamber 130 will cause movement (e.g., bounce) that is different from collisions with the concave interior portions of pea chamber 130. A collision of pea 1110 with floor 920 or ceiling 940 may cause pea 1110 to roll (e.g., move, slide) along the flat surface until flat portion 1214 or flat portion 1224 contacts the flat surface. Collisions at boundaries between a flat interior portion and a concave interior portion of pea chamber 130 will cause movement that is different from collisions with the concave interior portions or the flat portions alone of pea chamber 130.

Pea chamber 130 may include one or more flat interior portions. In one implementation, pea chamber 130 includes only floor 920. In another implementation, pea chamber 130 includes only ceiling 940. In another implementation, pea chamber 130 includes both floor 920 and ceiling 940. A flat portion of an interior surface of lid 110 may act as an additional flat surface in pea chamber 130. An interior flat surface of lid 110 may merely extend ceiling 940 to pea chamber outlet 132.

The varied and/or unpredictable movements of pea 1110 due to its shape responsive to air flow, turbulence, and/or collisions provides whistle 100 with a unique trill from pea chamber 130.

The foregoing description discusses preferred embodiments of the present invention, which may be changed or modified without departing from the scope of the present invention as defined in the claims. Examples listed in parentheses may be used in the alternative or in any practical combination. As used in the specification and claims, the words 'comprising', 'including', and 'having' introduce an open ended statement of component structures and/or functions. In the specification and claims, the words 'a' and 'an' are used as indefinite articles meaning 'one or more'. While for the sake of clarity of description, several specific embodiments of the invention have been described, the scope of the invention is intended to be measured by the claims as set forth below.

What is claimed is:

1. A whistle comprising:
a chamber; and
a pea; wherein:
the pea comprises a first semi-sphere and a second semi-sphere;
a flat portion of the first semi-sphere is coupled to a flat portion of the second semi-sphere;
an axis of the first semi-sphere is offset from an axis of the second semi-sphere thereby providing the pea a non-spherical shape;
the pea is positioned in the chamber; and
responsive to a flow of air into the chamber, the shape of the pea causes the pea to bounce in an unpredictable direction from an interior surface of the chamber to produce a trill.

2. The whistle of claim 1 wherein a magnitude of the offset is between about 3 and about 50 percent of the diameter of the flat portion of one of the semi-spheres.

3. The whistle of claim 1 wherein a magnitude of the offset is about 13 percent of the diameter of the flat portion of one of the semi-spheres.

4. The whistle of claim 1 wherein the diameter of the flat portion of the first semi-sphere is about the same as the diameter of the second semi-sphere.

5. The whistle of claim 1 wherein the diameter of the flat portion of the first semi-sphere is greater than the diameter of the second semi-sphere.

6. The whistle of claim 1 wherein at least one of the first semi-sphere and the second semi-sphere is formed of a resilient material.

7. The whistle of claim 1 wherein at least one of the first semi-sphere and the second semi-sphere is formed of rubber.

8. The whistle of claim 1 wherein the interior surface of the chamber is concave except for a portion that is flat.

9. The whistle of claim 1 wherein:
the interior surface of the chamber is concave except for a portion that is flat;
responsive to the flow of air into the chamber, the flat portion of the interior surface of the chamber further causes the pea to bounce unpredictably from the interior surface to produce the trill.

10. The whistle of claim 1 further comprising a flute and a tongue, wherein:
the tongue divides the flute into a first portion and a second portion;
the chamber receives the flow of air via the first portion and the second portion of the flute;

an end portion of the tongue protrudes into the chamber to perturb the flow of air in the chamber; and the pea further bounces further responsive to perturbation of the flow of air.

11. A whistle comprising:

a chamber; and a pea; wherein:

the pea comprises a first semi-sphere having a first diameter of a flat portion of the first semi-sphere and a second semi-sphere having a second diameter of a flat portion of the second semi-sphere;

the first diameter is greater than the second diameter;

the flat portion of the first semi-sphere is coupled to the flat portion of the second semi-sphere;

an axis of the first semi-sphere is aligned with an axis of the second semi-sphere so that a portion of the flat portion of the first semi-sphere is exposed, thereby providing the pea a non-spherical shape;

the pea is positioned in the chamber; and responsive to a flow of air into the chamber, the shape of the pea causes the pea to bounce in an unpredictable direction from an interior surface of the chamber to produce a trill.

12. The whistle of claim 11 wherein the first diameter is greater than the second diameter by between about 1 and about 5 percent of the first diameter.

13. The whistle of claim 11 wherein the first diameter is greater than the second diameter by between about 3 and about 10 percent of the first diameter.

14. The whistle of claim 11 wherein at least one of the first semi-sphere and the second semi-sphere is formed of a resilient material.

15. The whistle of claim 11 wherein at least one of the first semi-sphere and the second semi-sphere is formed of rubber.

16. The whistle of claim 11 wherein the interior surface of the chamber is concave except for a portion that is flat.

17. The whistle of claim 11 wherein:

the interior surface of the chamber is concave except for a portion that is flat;

responsive to the flow of air into the chamber, the flat portion of the interior surface of the chamber further causes the pea to bounce unpredictably from the interior surface to produce the trill.

18. The whistle of claim 11 further comprising a flute and a tongue, wherein:

the tongue divides the flute into a first portion and a second portion;

the chamber receives the flow of air via the first portion and the second portion of the flute;

an end portion of the tongue protrudes into the chamber to perturb the flow of air in the chamber; and the pea further bounces further responsive to perturbation of the flow of air.

* * * * *